US008689522B2

(12) United States Patent
Hoffman et al.

(10) Patent No.: US 8,689,522 B2
(45) **Date of Patent: *Apr. 8, 2014**

(54) METHOD FOR SETTING TILES AND TUNING LIPPAGE

(71) Applicant: New Standards Manufacturing Co., Keokuk, IA (US)

(72) Inventors: James P. Hoffman, Keokuk, IA (US); Ernest L. Perry, Vinton, IA (US); Michele Volponi, Keokuk, IA (US)

(73) Assignee: New Standards Manufacturing Co., Keokuk, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/059,989

(22) Filed: Oct. 22, 2013

(65) Prior Publication Data

US 2014/0041335 A1 Feb. 13, 2014

Related U.S. Application Data

(60) Division of application No. 13/855,471, filed on Apr. 2, 2013, which is a division of application No. 13/613,117, filed on Sep. 13, 2012, now Pat. No. 8,429,879, which is a continuation-in-part of application No. 13/296,737, filed on Nov. 15, 2011, now Pat. No. 8,429,878.

(60) Provisional application No. 61/646,677, filed on May 14, 2012, provisional application No. 61/601,808, filed on Feb. 22, 2012, provisional application No. 61/592,357, filed on Jan. 30, 2012.

(51) Int. Cl.

| | |
|---|---|
| ***E04B 1/00*** | (2006.01) |
| ***E04G 21/00*** | (2006.01) |
| ***E04F 13/08*** | (2006.01) |
| ***E04F 21/22*** | (2006.01) |

(52) U.S. Cl.

CPC ..... *E04F 13/0892* (2013.01); *E04F 21/22* (2013.01); *E04F 13/0889* (2013.01)

USPC ..... 52/747.11

(58) Field of Classification Search

CPC ..... E04B 1/00; E04G 21/00; E04F 15/00; E04F 13/0892; E04F 13/0889; E04F 15/02; E04F 15/02005; E04F 21/0092; E04F 21/22

USPC ..... 52/58, 60, 302.5, 302.6, 631, 716.2, 52/741

See application file for complete search history.

(56) References Cited

U.S. PATENT DOCUMENTS

| | | | |
|---|---|---|---|
| 1,918,228 | A | 7/1933 | Spencer |
| 2,277,892 | A | 3/1942 | Swenson |

(Continued)

FOREIGN PATENT DOCUMENTS

| | | | |
|---|---|---|---|
| JP | 07-305494 | A | 11/1995 |
| WO | PCT/US2012/055482 | | 9/2012 |

OTHER PUBLICATIONS

Kufner et al, The Lippage-Free Tile System, Web (www.tuscanleveling.com), 2006, Fairfield, IA.

*Primary Examiner* — Mark Wendell
*Assistant Examiner* — Keith Minter
(74) *Attorney, Agent, or Firm* — Simmons Perrine Moyer Bergman PLC

(57) ABSTRACT

A tile aligning and lippage tuning method and system that uses an under tile base reusable upright connecting tab, which is detachably connected to said under tile base, a reusable flexible edge slotted cap configured to slip over the connecting tab and latch thereto as the cap is slid further down the connecting tab. The cap has an edge slot so that the connecting tab can be separated from the cap, by merely sliding the cap, so that the connecting tab passes through the slot. A flexible spring-like portion of the cap provides increased force on the tile even if undesired elongation of the connecting tab occurs.

14 Claims, 13 Drawing Sheets

(56) References Cited

U.S. PATENT DOCUMENTS

| | | | |
|---|---|---|---|
| 3,511,001 | A | 5/1970 | Morgan |
| 4,397,125 | A | 8/1983 | Gusler |
| 5,345,990 | A | 9/1994 | Potts |
| 5,603,195 | A | 2/1997 | Consentino |
| 5,675,942 | A | 10/1997 | Crawford |
| 5,843,546 | A | 12/1998 | Eichhorn |
| 6,253,515 | B1 | 7/2001 | Kuelker |
| 7,257,926 | B1 | 8/2007 | Kirby |
| D552,266 | S | 10/2007 | Murdock |
| 7,621,100 | B2 | 11/2009 | Kufner et al. |
| D621,966 | S | 8/2010 | Vaes |
| D630,077 | S | 1/2011 | Kufner et al. |
| D630,078 | S | 1/2011 | Kufner et al. |
| 7,861,487 | B2 | 1/2011 | Kufner et al. |
| 7,946,093 | B1 | 5/2011 | Sturino |
| D640,119 | S | 6/2011 | Kufner et al. |
| 7,954,300 | B1 | 6/2011 | Kufner et al. |
| 7,992,354 | B2 | 8/2011 | Doda |
| 8,079,199 | B1 | 12/2011 | Kufner et al. |
| D658,963 | S | 5/2012 | Kufner et al. |
| 2006/0185269 | A1 | 8/2006 | Kufner et al. |
| 2006/0185319 | A1 | 8/2006 | Kufner et al. |
| 2010/0263304 | A1 | 10/2010 | Comas |
| 2010/0287868 | A1 | 11/2010 | Kufner et al. |
| 2011/0011031 | A1 | 1/2011 | Kufner et al. |
| 2011/0265424 | A1 | 11/2011 | Kufner et al. |
| 2012/0085066 | A1 | 4/2012 | Kufner et al. |
| 2012/0144773 | A1 | 6/2012 | Bondielli |

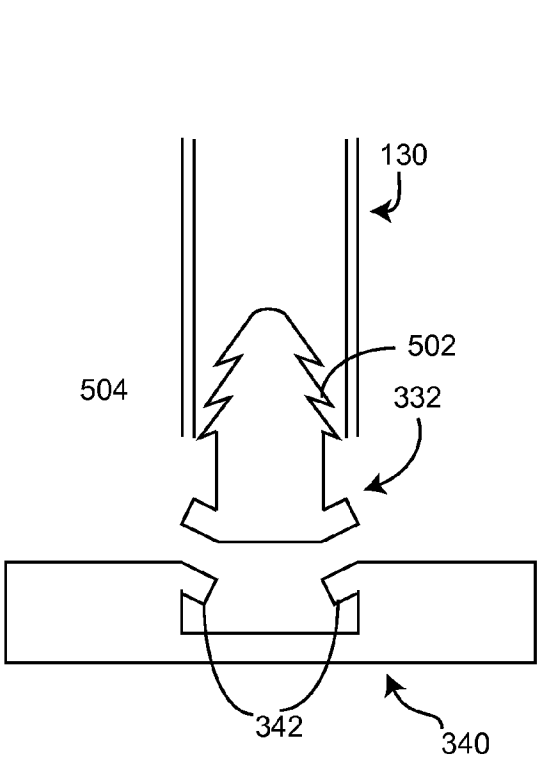
FIG. 6
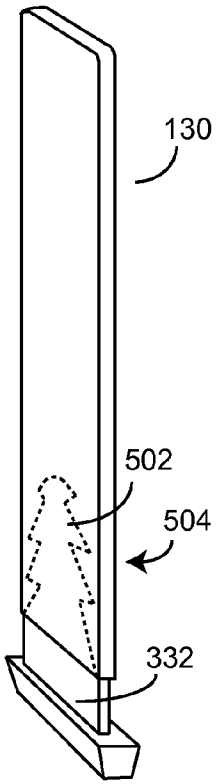
FIG. 5
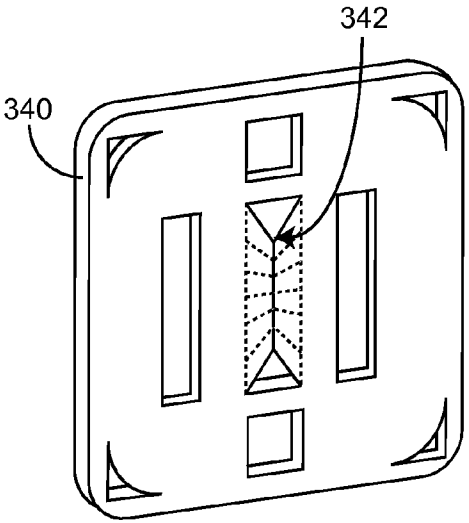

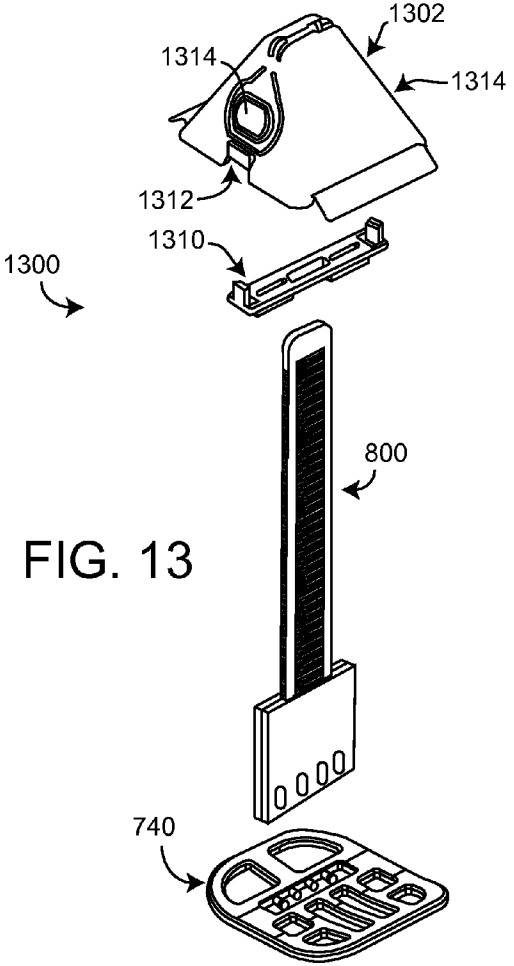
FIG. 13
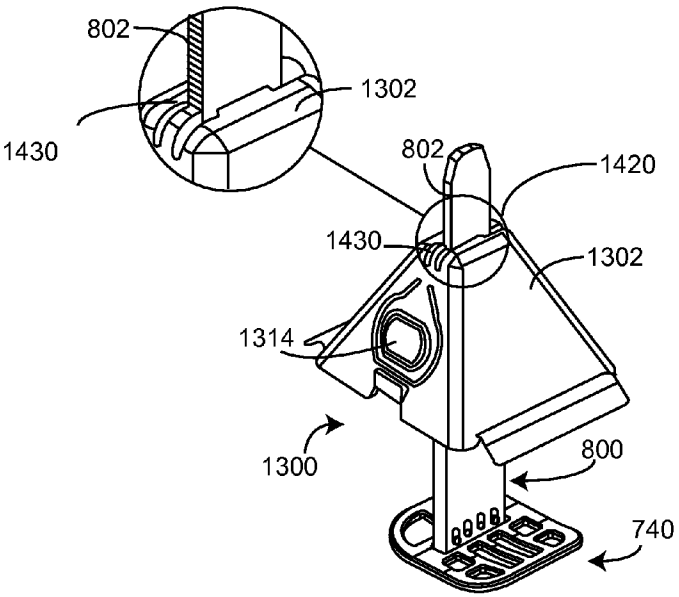
FIG. 14
FIG. 15

METHOD FOR SETTING TILES AND TUNING LIPPAGE

CROSS REFERENCE TO RELATED APPLICATIONS

This application claims the benefit of the filing dates of the following: provisional application Ser. No. 61/601,808 filed on Feb. 22, 2012; provisional patent application Ser. No. 61/592,357 filed on Jan. 30, 2012, and provisional application Ser. No. 61/646,677 filed on May 14, 2012. This application is also a continuation-in-part application of the application filed by the same inventors and having Ser. No. 13/296,737 filed on Nov. 15, 2011. This is a divisional application, which is pending and has Ser. No. 13/855,471 filed on Apr. 2, 2013, which is a divisional application, which has issued as U.S. Pat. No. 8,429,879 on Apr. 30, 2013. The above referenced prior applications and patents are all hereby incorporated herein in their entireties by these references.

BACKGROUND OF THE INVENTION

This invention relates to systems and methods for laying tile and more specifically for efficiently reducing tile lippage. Throughout this description, the term tile is used as an example of various matter which is arranged disposed adjacent a substrate (which can be horizontal—floors or vertical—walls or other) in multiple pieces, the term tile should be understood to include panels, sheets, boards, paving stones, bricks, stone or porcelain slabs or the like. The present invention relates more specifically to improved methods and systems which use tab systems to align tiles.

U.S. Pat. No. 7,861,487, U.S. Design Pat. D63077 and the web site www.tuscanleveling.com describe a system for aligning tiles. While such systems have enjoyed some success in the past, they do have drawbacks. At the conclusion of each job, the vertical shafts extending upwardly between the tile joints in such design are broken away from the base and discarded. This generates waste that may be disposed in landfills. In addition, the act of breaking the shaft can be time consuming and if not done properly, it can require additional steps which may increase exposure to damaging the tile.

Consequently, there is a need for improvement in tile aligning and lippage tuning systems and methods.

SUMMARY OF THE INVENTION

More specifically, an object of the invention is to provide a cost effective tile aligning and mechanical edge setting system.

It is a feature of the present invention to include reusable connecting tabs or shafts.

It is an advantage of the present invention to decrease the materials that are consumed or disposed of for each job.

It is another feature of the invention to include a cap system that is detachable from the tab or shaft, while it remains in place attached to the base located under the tile.

It is also an advantage of the present invention to provide improved ease of use and reduce unwanted dislocation of tiles after desired placement is accomplished.

It is another feature of the present invention to change how pressure is applied to the surface of the tile and the connecting tab.

It is another advantage of the present invention to reduce displacement of under tile adhesive material during plate insertion.

It is another advantage of the present invention to provide for the ability to maintain lippage reducing forces over a wider range of tab or shaft elongation.

The present invention includes the above-described features and achieves the aforementioned objects.

Accordingly, the present invention comprises a tile leveling and mechanical edge setting system with a reusable connecting tab; a cap which is easily removable from an attached connecting tab or shaft; or a spring like cap which provides for variable forces between the cap and the tile without any change in the separation between base and the tile.

BRIEF DESCRIPTION OF THE DRAWINGS

In the following description of the drawings, in which like reference numerals are employed to indicate like parts in the various views:

FIG. 5 shows a perspective exploded view of the tab and base combination of the present invention, where the dotted lines show underlying structure which would otherwise not be visible.

FIG. 6 shows a cross section exploded view of the tab and base combination of FIG. 5.

FIG. 13 is an exploded view of an alternate embodiment of the present invention with a side releasable cap.

FIG. 14 is an assembled view of the structure of FIG. 13.

FIG. 15 is a close up view of a portion of the structure of FIG. 14.

DETAILED DESCRIPTION OF THE DRAWINGS

Figure 1:
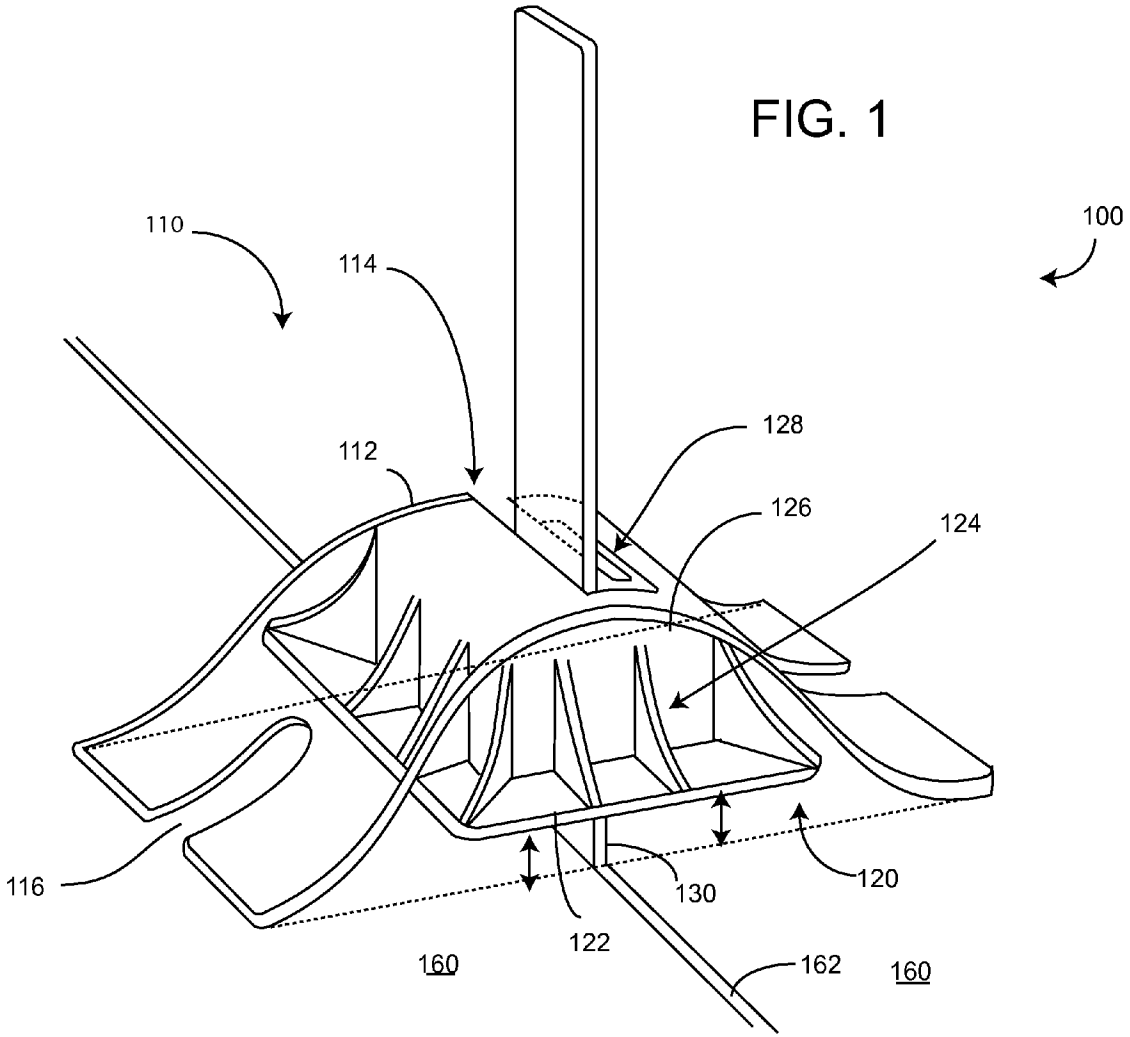
FIG. 1 is a perspective, partially transparent, view of the mechanical edge setting and lippage tuning system of the present invention, in its intended environment when a relatively low pressure is applied.
Figure 2:
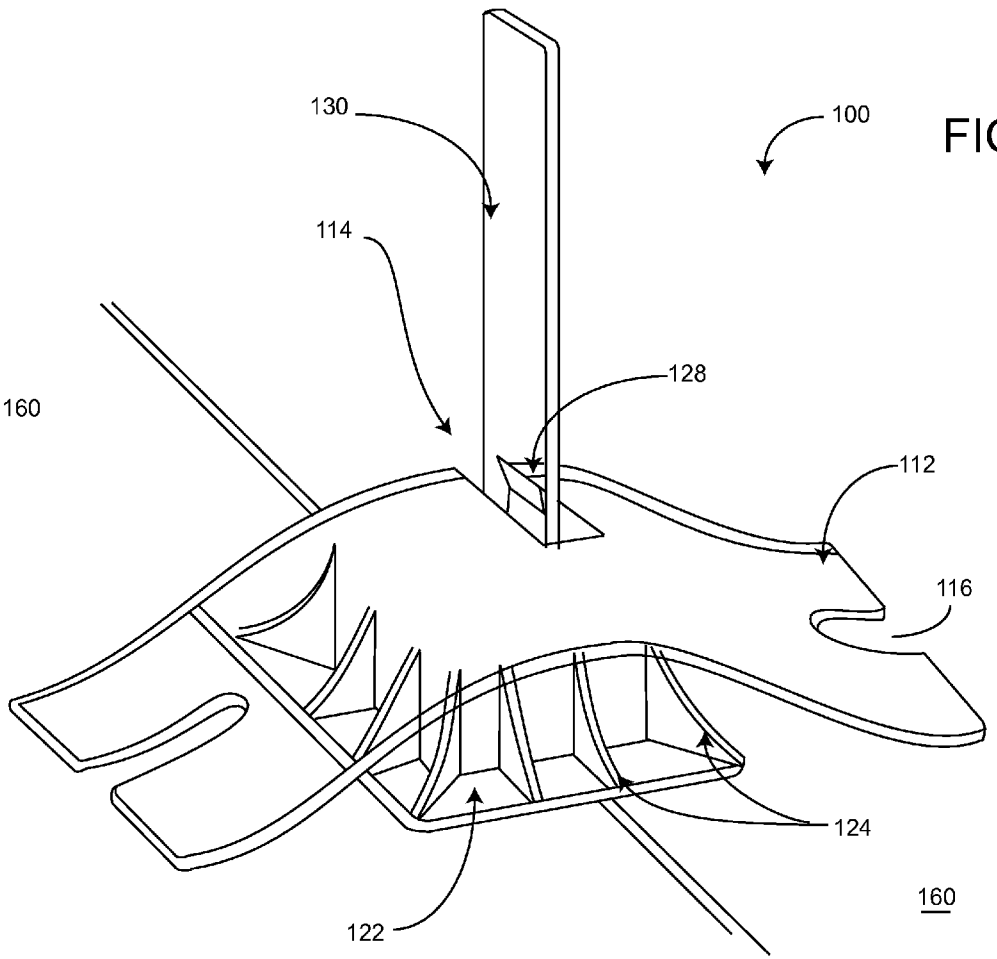
FIG. 2 is a perspective, partially transparent, view of the mechanical edge setting and lippage tuning system of FIG. 1, when a relatively higher pressure is applied.
Figure 3:
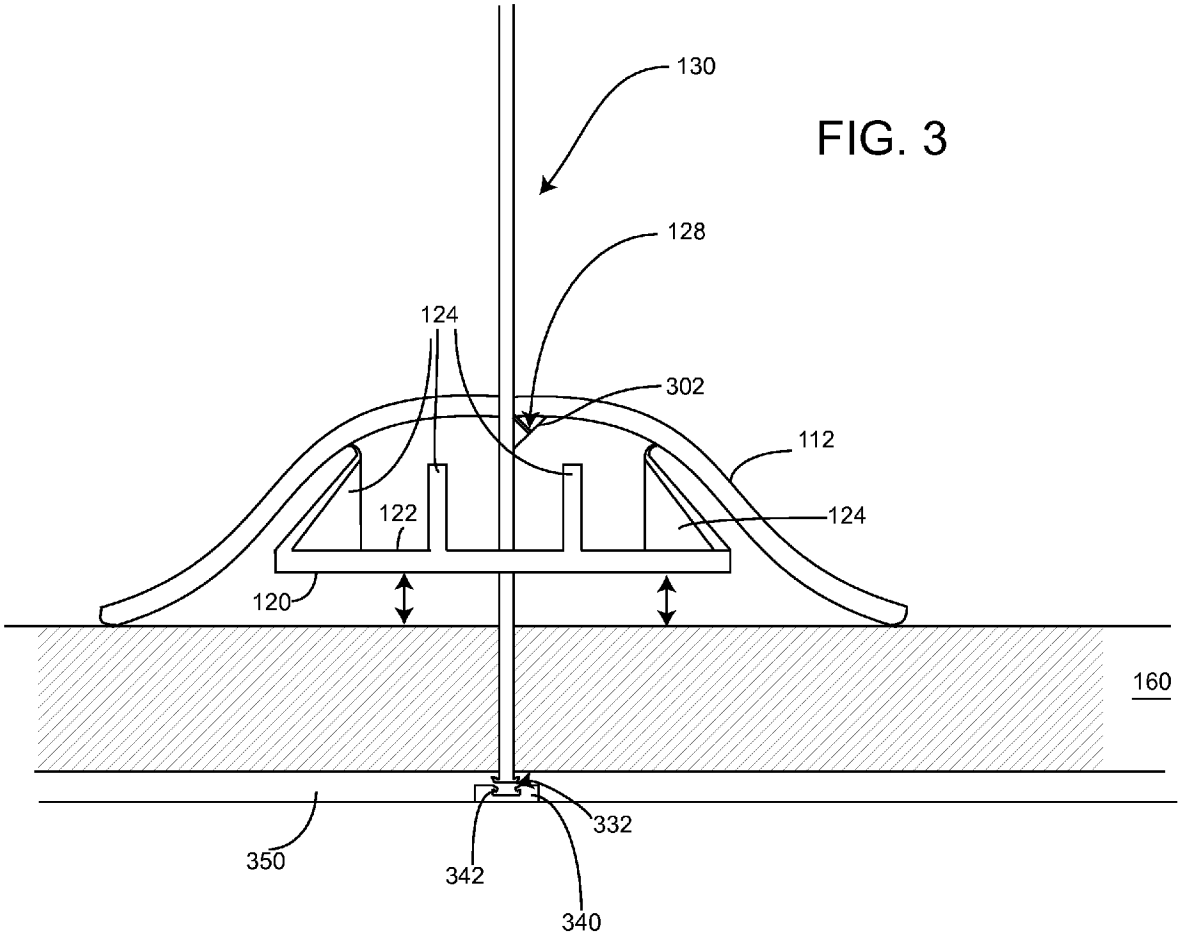
FIG. 3 shows a cross-sectional view of portions of the system as shown in FIG. 1.

Referring now to the drawings, where like numerals refer to like matter throughout, and more particularly to FIG. 1, there is shown a mechanical edge setting and lippage tuning system 100, which generally includes a cap system 110 and a connecting tab 130, which is disposed on the finished side of an array of tiles 160, with a joint 162 therebetween. Cap system 110 is shown having an upper cap spring-like portion 112 and a cap base portion 120. These may be a single piece or multiple pieces of the same or dissimilar material. Upper cap spring-like portion 112 needs to be resilient so as to act like a spring when compressed downward toward the tile. Note that upper cap spring-like portion 112 is shown in FIGS. 1 and 2 as being partially transparent so that the details of cap base portion 120 can be seen. Cap base portion 120 need not be as resilient but may be, if so desired. Cap system 110 and connecting tab 130 may be made of similar materials as prior art systems, such as described in the above referenced patent. However, connecting tab 130 may be made of metal, plastic, or rubber coated metal. Upper cap spring-like portion 112 includes an innovative edge tab removal slot 114 which allows for separation of the connecting tab 130 from the cap system 110; while the connecting tab 130 remains coupled to the sub tile base member 340 (FIG. 3). When cap system 110 is moved away, (e.g. slid in one direction) the connecting tab 130 passes through the edge of tab removal slot 114 and detachment occurs while connecting tab 130 remains in place. Note this can occur in the configuration of FIG. 1 or FIG. 2. It is not necessary to tip the cap system 110 and thereby increase the pressure at the pivot point and increase the potential for unwanted and potentially disruptive forces on the tile. Cap system 110 can be merely slid out of the way and the connecting tab 130 can then be detached without increasing any pressure on the top surface of the tile. Upper cap spring-like portion 112 also has an optional slot 116. Disposed underneath the upper cap spring-like portion 112 is cap base portion 120 which provides increased surface area for contact between the cap system 110 and the tile. Cap base buttress 124 provides support for the cap base portion core 126, which is located centrally in cap base portion 120. Also located in cap system 110 is gripping tongue 128, which is configured to firmly grip the connecting tab 130. Gripping tongue 128 may be made of plastic or may be a replaceable metal gripping tongue which is inserted as needed during the lifetime of the cap system. Note that connecting tab 130 does not necessarily require that there be surface features thereon in order to properly function.

One advantage of the present invention over the system of the above referenced patent is that the upper cap spring-like portion 112 acts like a spring, which can provide a force that tends to hold the adjacent tile in the same relative position, despite a stretching or thermal expansion of said connecting tab 130. Note in the above referenced patent, if the shaft were to become elongated (even in some cases by a very small amount) as a result of stretching or thermal expansion; then the force applied by the cap onto the adjacent tiles could be completely eliminated. The spring-like nature of the upper cap spring-like portion 112 makes it much less likely that enough elongation will occur to eliminate contact. In other words, it is not as likely that the elongation will be sufficient to overcome the amount of deflection of the upper cap spring-like portion 112.

Now referring to FIG. 2, there is shown a mechanical edge setting and lippage tuning system 100 of FIG. 1, which has been pressed downward so that the cap base flange 122 now touches the tile top surface. It can be seen that the contact surface between the cap system 110 and the tile includes both the points of contact between the upper cap spring-like portion 112 and the cap base flange 122. This area of contact can be several times the area of similar contact in the above described patent.

Now referring to FIG. 3, there is shown the cross-sectional view of the mechanical edge setting and lippage tuning system 100 of FIG. 1. Also shown is gripping tongue support member 302 which is shown as being coupled to the upper cap spring-like portion 112. Note that when upper cap spring-like portion 112 is pressed downward, as in FIGS. 2 and 4, there is deflection of upper cap spring-like portion 112 and therefore relative movement of gripping tongue support member 302/gripping tongue 128 mounted thereon with respect to the connecting tab 130. Also shown in FIG. 3 is the substrate mortar 350 and sub tile base member 340 which is placed in the mortar or against the substrate. Sub tile base member 340 is shown having base mating portion 342 for temporarily grasping the connecting tab base mating member 332 disposed on connecting tab 130. Note that the base mating portion 342 is designed to release the connecting tab base mating member 332 or otherwise disengage contact with the connecting tab 130 when a requisite force or series of forces is applied thereto. In one embodiment, connecting tab base mating member 332 is a portion of a reusable connecting tab that is removed from the sub tile base member 340 on one job and used again and again on other jobs. In such a configuration only the sub tile base member 340 is a consumable or non-reusable portion of the system. Note that connecting tab base mating member 332 is shown in an enlarged or exaggerated manner for clarity in FIGS. 3 and 4. FIGS. 5 and 6 show embodiments where the widest portion of connecting tab base mating member 332 is not any wider than the widest portion of the remainder of connecting tab 130; this allows for removal of the connecting tab 130 with connecting tab base mating member 332 through the joint in the tile without the need to remove any additional mortar.

Figure 4:
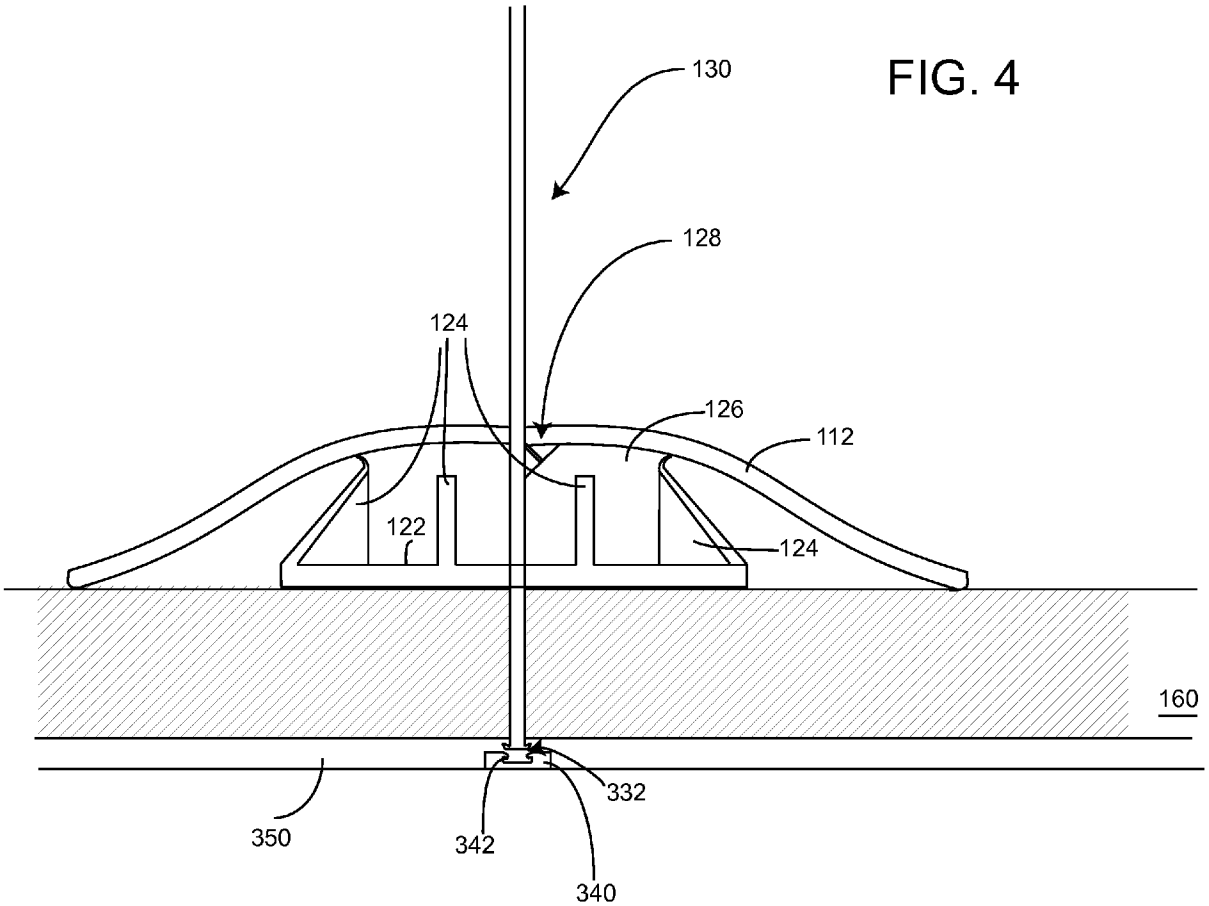
FIG. 4 shows a cross-sectional view of portions of the system as shown in FIG. 2.

Now referring to FIG. 4, there is shown a cross-sectional representation of the mechanical edge setting and lippage tuning system 100 of FIG. 2, which shows the cap base portion 120 touching the tile 160 and the upper cap spring-like portion 112 spread out further. After the initial contact between cap base flange 122 and tile 160 is fully made, the upper cap spring-like portion 112 is configured to apply a variable force between the cap base flange 122 and tile 160 by deflection of the upper cap spring-like portion 112 without any movement of the cap base portion 120 or the tile 160.

Now referring to FIG. 5, there is shown an exploded perspective view of the connecting tab 130 and sub tile base member 340 combination of the present invention. Sub tile base member 340 is shown having base mating portion 342 which is designed to temporarily grip connecting tab base mating member 332 and then release when the requisite forces are applied. Connecting tab 130 is shown having a connecting tab base mating member 332 which may be a separate metal piece inserted into a connecting tab end opening 504 so that connecting tab mating member internal gripping teeth 502 (shown in dotted lines) hold the connecting tab base mating member 332 in place with respect to the connecting tab 130.

Now referring to FIG. 6, there is shown an exploded cross-sectional view of the connecting tab 130 and sub tile base member 340 combination of the present invention.

In operation, the system of the present invention utilizes the following method:

The reusable connecting tab 130 is coupled to the sub tile base member 340. The system is used to align and level tile in a manner similar to the system described in the above referenced patent, except for the flexing of upper cap spring-like portion 112 after the cap base flange 122 contacts the tile.

In the present invention, the upper cap spring-like portion 112 may be, but not necessary, compressed and deflected when pressed toward the tile 160. This additional compression of cap system 110 after contact between the cap base flange 122 and the tile provides the force retaining feature to avoid problems associated with undesired elongation of the connecting tab 130.

At the desired time, (e.g. after the mortar is set) the cap system 110 can be removed from the surface of the tile 160 without tipping the cap system 110, temporarily increasing the forces between the cap and the tile. Instead, the cap system 110 is merely slid away from the connecting tab 130 while the connecting tab 130 remains coupled to the sub tile base member 340. After the cap system 110 has been separated from the connecting tab 130, the reusable connecting tab 130 is removed from the sub tile base member 340 without the need for increasing downward pressure on portions of the top surface of the tile 160.

The process is repeated for the entire connecting tab 130 and cap system 110 combinations utilized for the job and the reusable connecting tabs 130 are cleaned and stored for future reuse.

Figure 7:
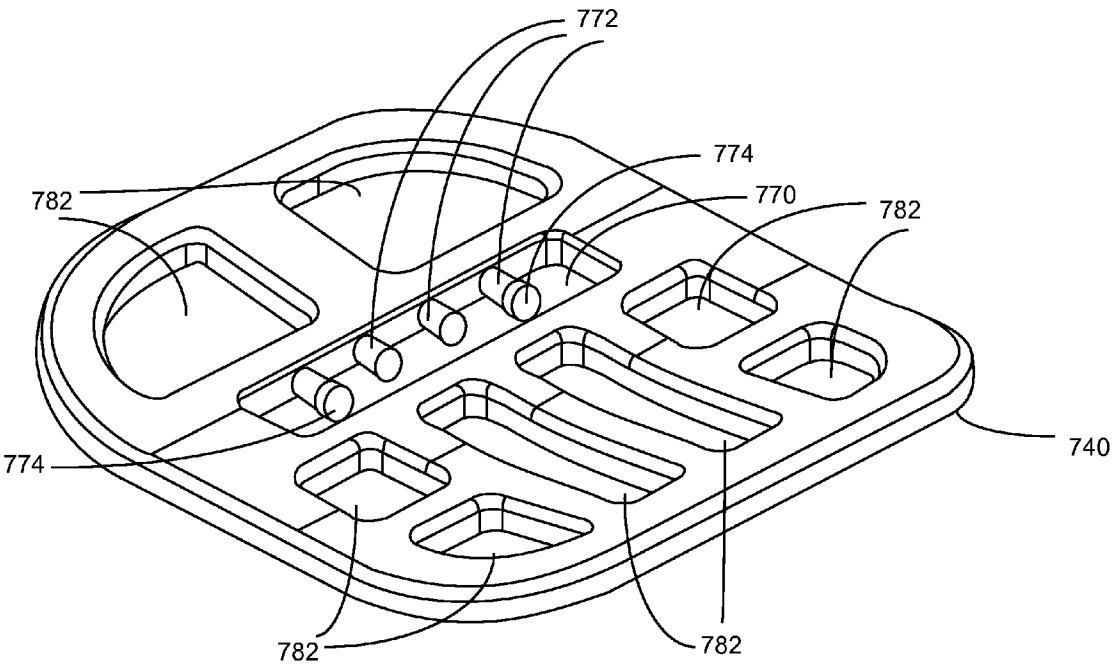
FIG. 7 shows a close up of a universal plate portion of the present invention.
Figure 8:
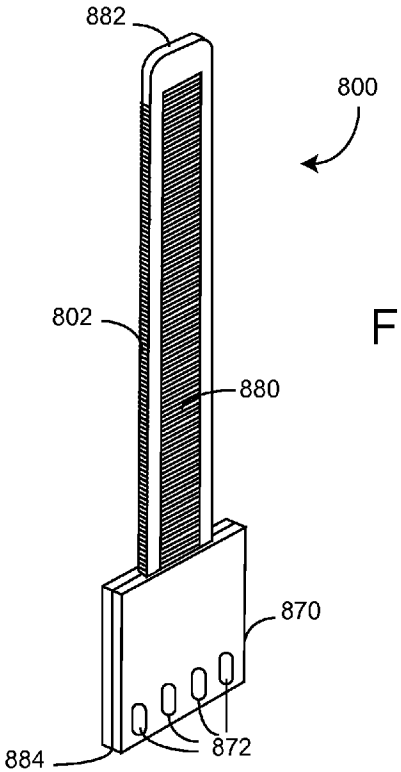
FIG. 8 shows a side view of a reusable strap of the present invention.

Now referring to FIGS. 7 and 8, there is shown a sub tile base member 740 which is similar in use and material to sub tile base member 340, however, sub tile base member 740 is configured with a strap receiving void 770 for receiving therein a reusable strap 800. Sub tile base member 740 is specially designed to allow the reusable strap 800 to be removed from attachment thereto by severing the various strap mating members. In one embodiment, these members are made so that they can be relatively easily broken and thereby facilitate removal of the reusable strap 800 by forcibly separating it from the strap mating members 772. In another embodiment, the outside strap mating member ends 774 have a larger end which is designed to facilitate ease of insertion followed by retention of the reusable strap 800 on the strap mating members 772 during the process of using the system to reduce lippage. The insertion process can be reversed and the strap mating member ends 774 can be aligned with enlarged portions of reusable strap mating section receiving holes 872 so as to be easily removed through the enlarged portions.

When the reusable strap 800 is pulled upward and the strap mating members 772 and strap mating member ends 774 contact the bottom of reusable strap mating section receiving holes 872, the play between the reusable strap 800 and the sub tile base member 740 is dramatically reduced, (i.e. the permitted range of relative movement is made much smaller). If even more upward (away from the grout joint) force is applied at this point, the strap mating members 772 and strap mating member ends 774 may be sheared or otherwise deformed to permit an alternate method of removal of the reusable strap 800 from the sub tile base member 740.

Also shown are various shaped mortar penetrating voids 782 so that the mortar beneath the sub tile base member 740 can bond with the tile above the sub tile base member 740.

Now referring to FIG. 8, there is shown a reusable strap 800 of the present invention, which is similar in many respects to connecting tab 130. Reusable strap 800 has a reusable strap top side 882 and a reusable strap bottom side 884 with a reusable strap mating section 870 at the bottom, which are attached to the main shaft of the reusable strap 800. Reusable strap 800 has a reusable strap ridged edge 802 and a reusable strap central ridges 880 section. The reusable strap ridged edge 802 is used for cooperation with edge grasping caps while the reusable strap central ridges 880 are for cooperating with strap center grasping caps. Reusable strap mating section 870 is preferably made of a metal or other material, which is substantially stronger than the material used for sub tile base member 740; in particular, the strap mating members 772 and the strap mating member ends 774. The entire reusable strap 800 is made strong enough that when the main shaft is pulled hard the strap mating members 772 and strap mating member ends 774 are sheared off, or otherwise caused to allow the reusable strap 800 to be pulled vertically from the strap receiving void 770. Reusable strap mating section receiving holes 872 are configured to slip over the strap mating members 772 and strap mating member ends 774 and then be pulled up during operation as pressure is applied when the cap is forced relatively down the reusable strap 800. The entire reusable strap 800 is preferably reusable so that it can be used on one job and then pulled out after the mortar is set and reused on another job or portion of a job.

Figure 9:
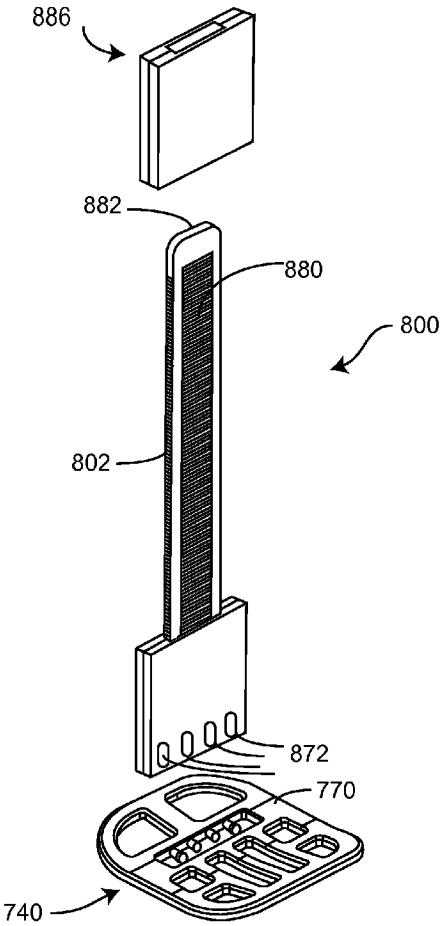
FIG. 9 shows an exploded view of the present invention including the universal plate portion of FIG. 7 and the reusable strap of FIG. 8.

Now referring to FIG. 9, there is shown an exploded view of the system of the present invention which includes a reusable strap narrow grout spacer 886.

Figure 10:
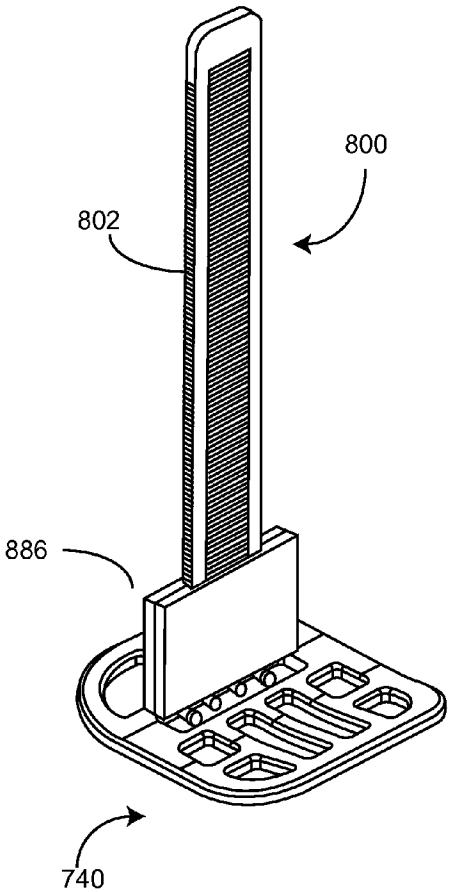
FIG. 10 shows a side view of the assembled structure also shown in FIG. 9.

Now referring to FIG. 10, there is shown an assembled version of the system of claim 9.

Figure 11:
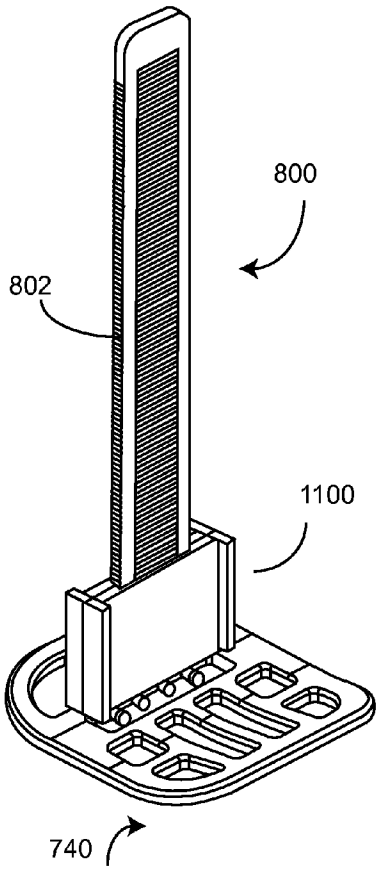
FIG. 11 is an alternate embodiment of the present invention.

Now referring to FIG. 11, there is a variation of the system of FIG. 10 but with a reusable strap medium grout spacer 1100.

Figure 12:
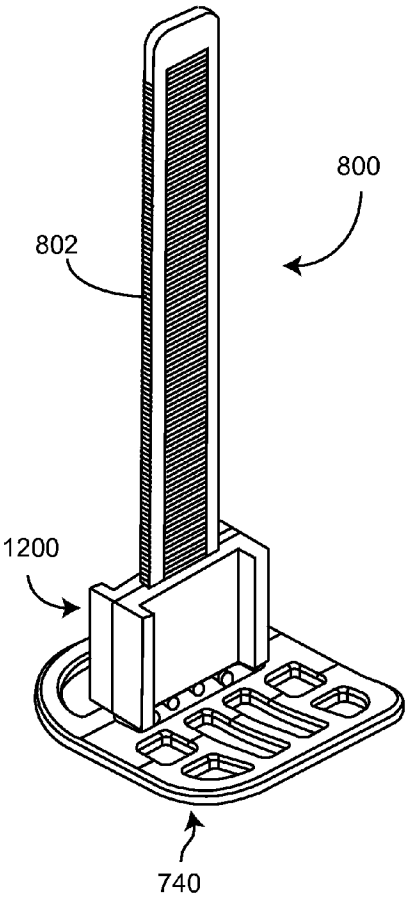
FIG. 12 is an alternate embodiment of the present invention.

Now referring to FIG. 12, there is a variation of the system of FIG. 11 but with a reusable strap wide grout spacer 1200.

Now referring to FIG. 13, there is shown an exploded view of a system of the present invention which includes a side releasable cap 1302, which includes grout space attachment clips 1312, which are grasped by a top portion of an end part of changeable grout spacer 1310. Disposed above grout space attachment clips 1312 is a pair of opposing strap releasing buttons 1314 (one shown, but an identical button could be found on the opposite side of side releasable cap 1302). When buttons 1314 are pressed, then strap edge grasping catch 1430 (FIG. 14) is pulled away from the reusable strap ridged edge 802 of reusable strap 800, thereby releasing the connection therebetween.

Now referring to FIG. 14, there is shown an assembled view of the structure of FIG. 13.

Now referring to FIG. 15, there is shown an enlarged view of the coupling between the side releasable cap and the reusable strap. The reusable strap ridged edge 802 is shown mating with the strap edge grasping catch 1430.

Figure 16:
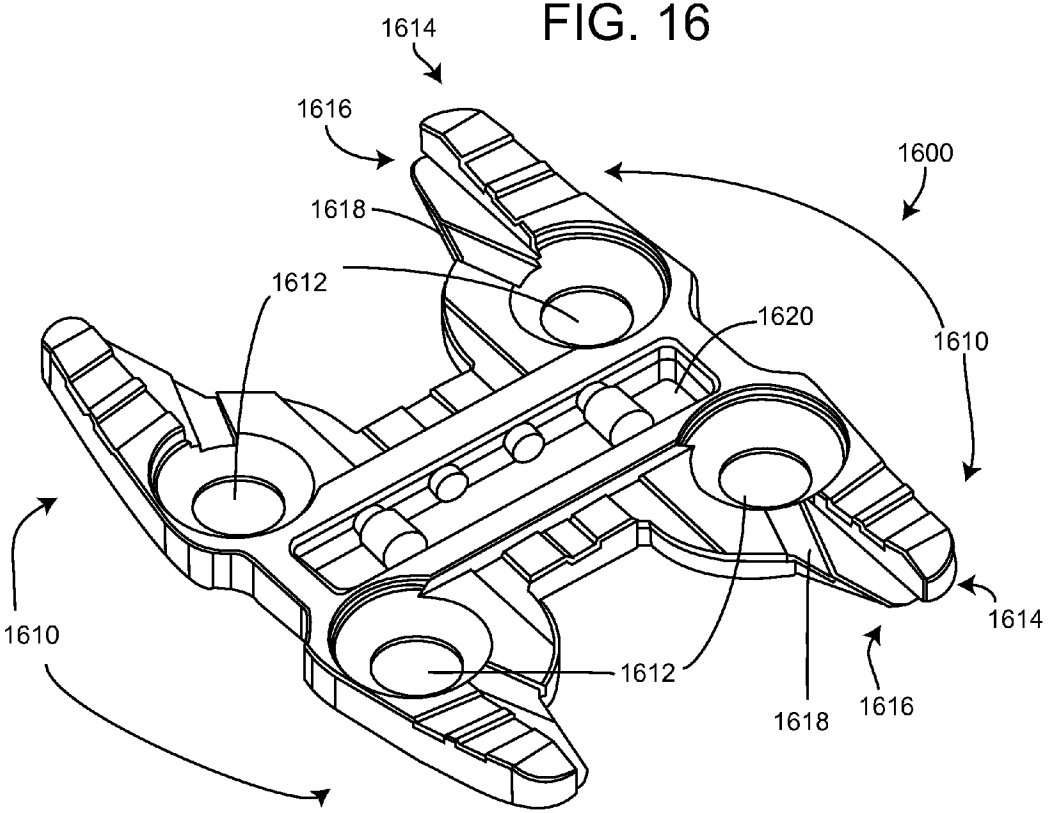
FIG. 16 is a perspective view of an alternate embodiment of the plate of the present invention.

Now referring to FIG. 16, there is shown a plate of the present invention, generally designated 1600 which includes a strap receiving void 1620 and four prongs 1610, where each prong 1610 includes an outer raised portion 1614 and an inner upwardly sloped ramp portion 1616 with an adhesive material receiving groove 1618 therein. Plate 1600 also includes 4 screw holes 1612 for use in ceiling and non-flooring applications.

Figure 17:
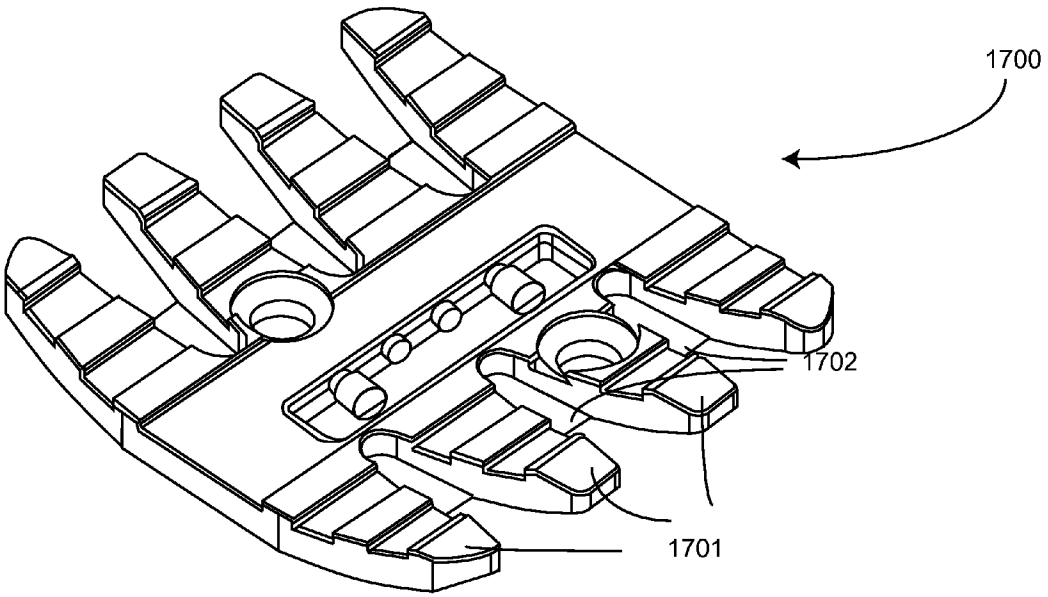
FIG. 17 is a perspective view of an alternate embodiment of the plate of the present invention.

Now referring to FIG. 17, there is shown an alternate embodiment of the present invention, generally designated 1700, which includes a plurality of prongs 1701 with partial height and length interstitial joining portions 1702.

Figure 18:
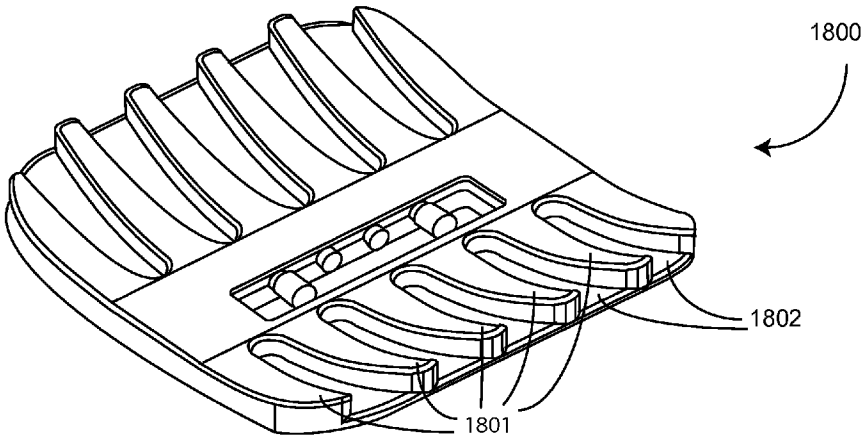
FIG. 18 is a perspective view of an alternate embodiment of the plate of the present invention.

Now referring to FIG. 18, there is shown an alternate embodiment of the present invention, generally designated 1800, which includes a plurality of prongs 1801 with partial height and full length interstitial joining portions 1802.

Figure 19:
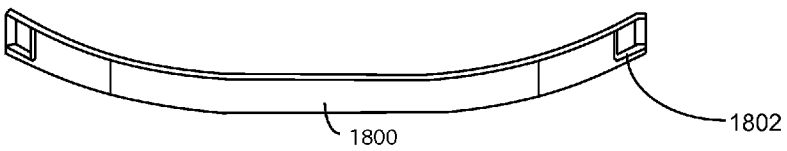
FIG. 19 is an elevation view of the plate of FIG. 18.

Now referring to FIG. 19, there is shown an elevation view of the plate 1800 of FIG. 18.

Throughout this description the term lippage is used and is hereby defined as meaning relatively uneven edges existing with respect to adjacent tiles arranged in an array.

It is believed that when these teachings are combined with the known prior art by a person skilled in the art of the prior art systems, many of the beneficial aspects and the precise approaches to achieve those benefits will become apparent.

It will be understood that certain features and sub-combinations are of utility and may be employed without reference to other features and sub-combinations. This is contemplated by and is within the scope of the claims.

Since many possible embodiments may be made of the invention without departing from the scope thereof, it is understood that all matter herein shown in the accompanying drawings is to be interpreted as illustrative and not in a limiting sense.

We claim:

1. A method of aligning tile comprising the steps of:

providing a first tile base member with a tile base mating portion;

providing a connecting tab with a connecting tab base mating portion thereon;

causing a said first tile base member to be disposed between a first plurality of adjacent tiles and a first substrate and said connecting tab to extend outwardly in a gap between said first plurality of adjacent tiles;

coupling a cap onto said connecting tab and into a retained configuration while said cap is in contact with said first plurality of adjacent tiles;

removing said connecting tab from said first tile base member and reusing said connecting tab by mating said connecting tab with a second tile base member;

where said step of removing said connecting tab occurs before any step of separating said cap from said connecting tab.

2. The method of claim 1 further comprising the step of sliding said cap in a plane defined by a top surface of said first plurality of adjacent tiles and thereby separating said cap from said connecting tab.

3. The method of claim 2 wherein said step of removing said connecting tab from said first tile base member comprises applying a non-destructive multi-step and multi-angle force to slide said connecting tab along a plurality of strap mating members, forming at least a portion of said tile base mating portion and extending within a void in said first tile base member.

4. The method of claim 1 wherein said step of removing said connecting tab from said first tile base member comprises pulling on said connecting tab and deforming portions of said first tile base member.

5. A method of aligning tile comprising the steps of:

providing a first member with a mating portion;

providing a tab with a tab mating portion thereon;

causing a said first member to be disposed between a first plurality of adjacent tiles and a first backing layer and said tab to extend outwardly in a gap between said first plurality of adjacent tiles;

coupling a cap to said tab and into a retained configuration so that said cap provides a biasing force with respect to said first plurality of adjacent tiles;

removing said tab from said first member and reusing said tab by mating said tab with a second member;

where said step of removing said tab occurs before any step of separating said cap from said tab.

6. The method of claim 5 further comprising the step of sliding said cap in a plane defined by a top surface of said first plurality of adjacent tiles and thereby separating said cap from said tab.

7. The method of claim 6 wherein said step of removing said tab from said first member comprises applying a non-destructive multi-step and multi-angle force to slide said tab along a plurality of strap mating members, forming at least a portion of said mating portion and extending within a void in said first member.

8. The method of claim 5 where said biasing force is provided directly on said plurality of adjacent tiles.

9. The method of claim 5 wherein said step of removing said tab from said first member comprises pulling on said tab and severing portions of said first base member.

10. A method of aligning tile being adhered to a backing layer comprising the steps of:

providing a first base member with a base mating portion;

providing a connecting tab with a connecting tab base mating portion thereon;

causing a said first base member to be disposed between a first plurality of adjacent objects and a first substrate and said connecting tab to extend outwardly in a gap between said first plurality of adjacent objects;

coupling a cap onto said connecting tab and into retained configuration so that said cap provides a biasing force with respect to said first plurality of adjacent objects;

removing said connecting tab from said first base member and reusing said connecting tab by mating said connecting tab with a second base member;

where said step of removing said connecting tab occurs before any step of separating said cap from said connecting tab.

11. The method of claim 10 further comprising the step of sliding said cap in a plane defined by a top surface of said first plurality of adjacent objects and thereby separating said cap from said connecting tab.

12. The method of claim 11 wherein said step of removing said connecting tab from said first base member, comprises applying a non-destructive multi-step and multi-angle force to slide said connecting tab along a plurality of strap mating members forming at least a portion of said base mating portion and extending within a void in said first base member.

13. The method of claim 10 wherein said plurality of adjacent object comprises a plurality of tiles.

14. The method of claim 10 where said biasing force is provided directly on said plurality of adjacent objects.

* * * * *